US010683130B2

(12) United States Patent
Takeuchi

(10) Patent No.: US 10,683,130 B2
(45) Date of Patent: Jun. 16, 2020

(54) PACKING CASE

(71) Applicant: KYOCERA Document Solutions Inc., Osaka (JP)

(72) Inventor: Masakazu Takeuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/116,130

(22) Filed: Aug. 29, 2018

(65) Prior Publication Data

US 2019/0061993 A1 Feb. 28, 2019

(30) Foreign Application Priority Data

Aug. 31, 2017 (JP) ..... 2017-167533

(51) Int. Cl.

| | |
|---|---|
| ***B65D 5/50*** | (2006.01) |
| ***B65D 5/20*** | (2006.01) |
| ***B65D 5/66*** | (2006.01) |
| *B65D 5/42* | (2006.01) |
| *B65D 5/00* | (2006.01) |

(52) U.S. Cl.

CPC ..... *B65D 5/5004* (2013.01); *B65D 5/2047* (2013.01); *B65D 5/6694* (2013.01); *B65D 5/006* (2013.01); *B65D 5/4266* (2013.01)

(58) Field of Classification Search

CPC .. B65D 5/5004; B65D 5/2047; B65D 5/6694; B65D 5/5006; B65D 5/0254; B65D 2585/689; B65D 2585/6892; B65D 5/50; B65D 5/505; B65D 5/6608; B65D 81/02; G03G 21/181; G03G 2215/0875; G03G 2215/0886

USPC ..... 229/199, 150, 142, 153, 192; 206/521

See application file for complete search history.

(56) References Cited

U.S. PATENT DOCUMENTS

| | | | | |
|---|---|---|---|---|
| 4,535,929 | A * | 8/1985 | Sherman, II | B65D 5/103 206/459.5 |
| 4,830,270 | A * | 5/1989 | Holmes | B65D 5/0254 206/807 |
| 2011/0233205 | A1* | 9/2011 | Suzuki | B65D 5/0254 220/4.01 |
| 2012/0144783 | A1* | 6/2012 | Nakamura | B65D 5/5004 53/473 |
| 2016/0214758 | A1* | 7/2016 | Yamamura | B65D 5/6608 |
| 2016/0214760 | A1* | 7/2016 | Takeuchi | B65D 5/3621 |

(Continued)

FOREIGN PATENT DOCUMENTS

| | | |
|---|---|---|
| JP | 2000-103422 | 4/2000 |

*Primary Examiner* — Christopher R Demeree

(74) *Attorney, Agent, or Firm* — Wenderoth, Lind & Ponack, L.L.P.

(57) ABSTRACT

A packing case includes a body part having a quadrangular section and a bottom part for closing a lower opening of the body part. The body part includes first to fourth side plates forming sides of the quadrangle, and first to fourth bottom plate pieces are respectively connected to lower end parts of the first to fourth side plates via fold lines. The bottom part is configured by allowing the first to fourth bottom plate pieces folded to a side of the lower opening along the fold lines to be integrally engaged with one another and to be connected with one another, and at least one support piece, which is able to assemble support body that support an object to be packed, is connected to at least one of the first to fourth bottom plate pieces.

1 Claim, 11 Drawing Sheets

(56) References Cited

U.S. PATENT DOCUMENTS

| | | | | |
|---|---|---|---|---|
| 2017/0203902 | A1* | 7/2017 | Yamamura | B65D 5/5059 |
| 2017/0341802 | A1* | 11/2017 | Sumitomo | B65D 5/0236 |

* cited by examiner

PACKING CASE

CROSS-REFERENCE TO RELATED APPLICATION

This application is based upon and claims the benefit of priority from Japanese Patent Application No. 2017-167533 filed on Aug. 31, 2017, the entire contents of which are incorporated herein by reference.

BACKGROUND

The technology of the present disclosure relates to a packing case.

A packing case includes a body part having a quadrangular section, a lid that closes an upper opening of the body part, and a bottom part that closes a lower opening of the body part, and for example, is formed in a developing shape with a corrugated cardboard and is assembled in a three-dimensional shape from the developing shape.

In the aforementioned packing case, the bottom part, for example, is configured as so-called an entangled bottom to be simply assembled without using an adhesive tape and the like. In such a packing case, a buffer material is received as a support body, which supports an object to be packed, together with the object to be packed. The position of the object to be packed is decided by the buffer material, and the impact on the object to be packed is absorbed.

SUMMARY

A packing case according to one aspect of the present disclosure includes a body part having a quadrangular section and a bottom part for closing a lower opening of the body part.

The body part includes first to fourth side plates forming sides of the quadrangle. The first to fourth bottom plate pieces are respectively connected to lower end parts of the first to fourth side plates via fold lines. The bottom part is configured by allowing the first to fourth bottom plate pieces folded to a side of the lower opening along the fold lines to be engaged with one another and to be integrally connected with one another. At least one support piece, which can assemble support body that supports an object to be packed, is connected to at least one of the first to fourth bottom plate pieces.

DETAILED DESCRIPTION

Hereinafter, an example of an embodiment will be described on the basis of the drawings.

Figure 1:
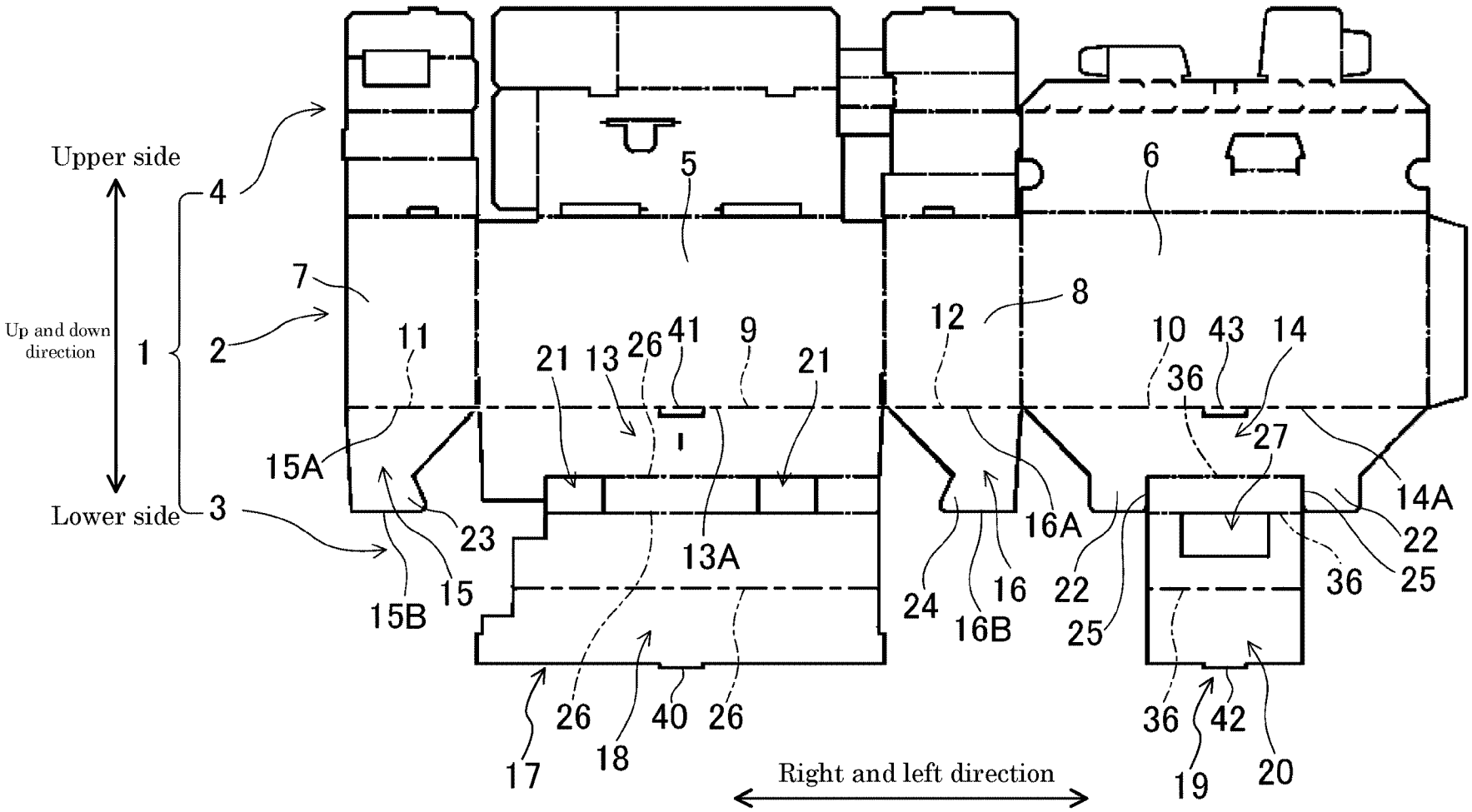
FIG. 1 is a development view of a packing case.
Figure 11:
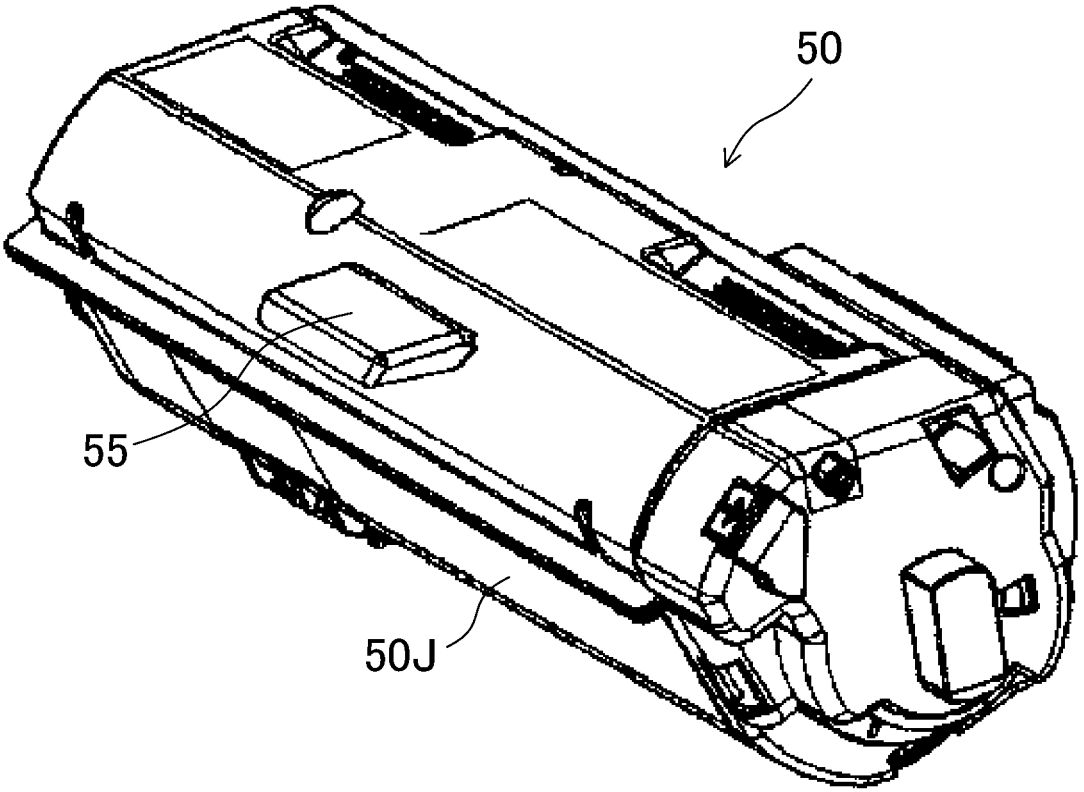
FIG. 11 is a perspective view of a toner container received in a packing case.

FIG. 1 illustrates a development view of a packing case 1 assembled by folding a corrugated cardboard made from paper. The packing case 1 receives a toner container 50 (corresponding to an object to be packed) of an image forming apparatus illustrated in FIG. 11.

As illustrated in FIG. 1, FIG. 2, FIG. 5, FIG. 8, and FIG. 9, the packing case 1 includes a body part 2 in which a transverse section is a quadrangular shape, a bottom part 3 that closes a lower opening K of the body part 2, and a lid 4 that closes an upper opening of the body part 2.

[Structure of First to Fourth Side Plates 5 to 8]

The body part 2 includes the first to fourth side plates 5 to 8 that form sides of the quadrangle. The first to fourth side plates 5 to 8 are formed in a rectangular shape, wherein the first side plate 5 and the second side plate 6 face each other and the third side plate 7 and the fourth side plate 8 face each other. In the transverse section, the first side plate 5 and the second side plate 6 are set to be longer than the third side plate 7 and the fourth side plate 8.

[Structure of First to Fourth Bottom Plate Pieces 13 to 16]

Figure 2:
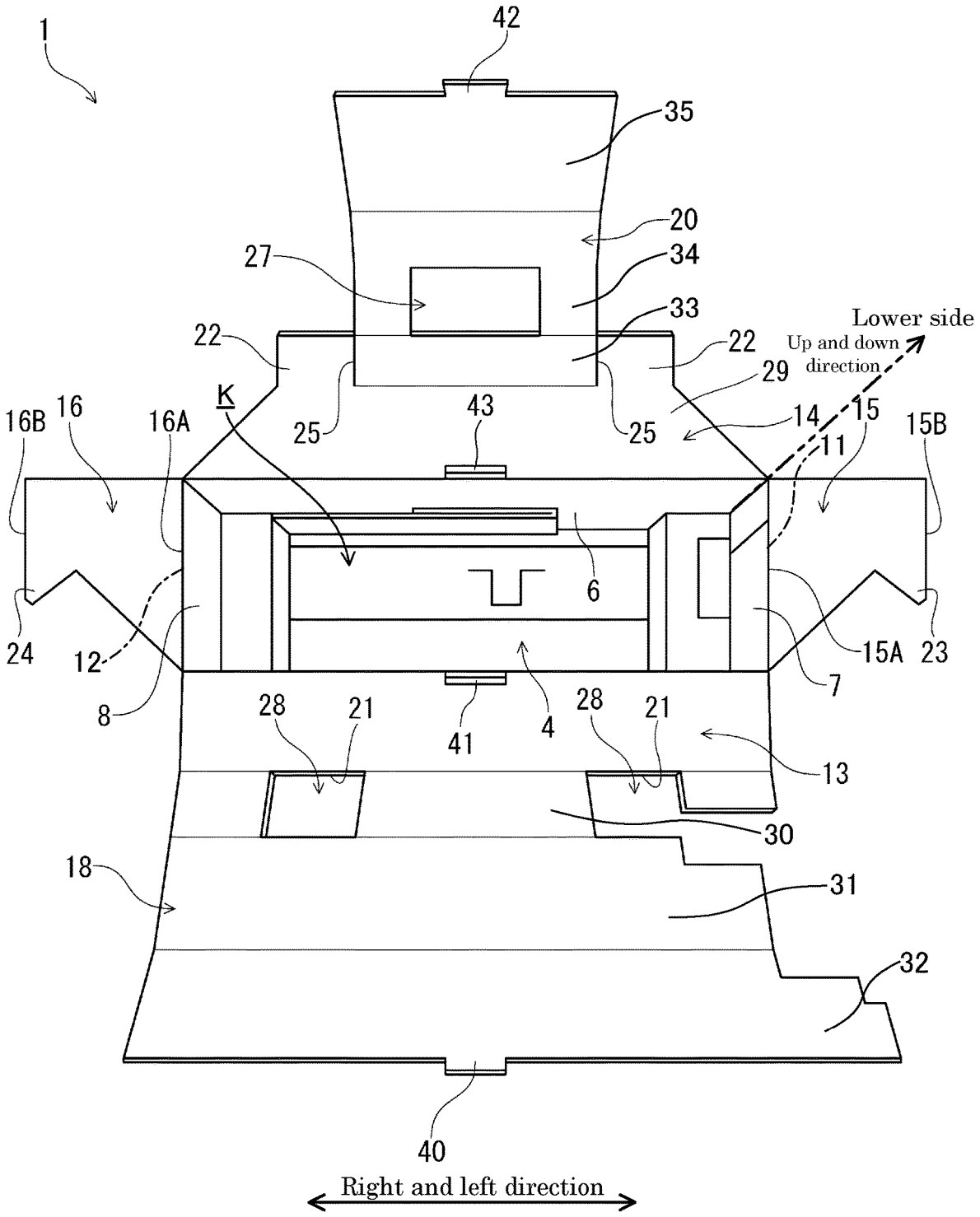
FIG. 2 is a bottom view of a packing case in which first to fourth bottom plate pieces are opened.

As illustrated in FIG. 1 and FIG. 2, the first to fourth bottom plate pieces 13 to 16 are individually connected to the lower end parts of the first to fourth side plates 5 to 8 via fold lines 9 to 12, respectively. That is, the first bottom plate piece 13 corresponding to the first side plate 5 is connected to the lower end part of the first side plate 5 via the fold line 9, and the second bottom plate piece 14 corresponding to the second side plate 6 is connected to the lower end part of the second side plate 6 via the fold line 10. Moreover, the third bottom plate piece 15 corresponding to the third side plate 7 is connected to the lower end part of the third side plate 7 via the fold line 11, and the fourth bottom plate piece 16 corresponding to the fourth side plate 8 is connected to the lower end part of the fourth side plate 8 via the fold line 12.

The bottom part 3 is formed by allowing the first to fourth bottom plate pieces 13 to 16 folded to the lower opening K side along the fold lines 9 to 12 to be engaged with one another and to be integrally connected with one another, and is configured as so-called an entangled bottom. In this way, it is possible to simply assemble the bottom part 3 without using an adhesive tape and the like.

Lower ends of the first to fourth side plates 5 to 8 and base ends 13A to 16A of the first to fourth bottom plate pieces 13 to 16 correspond to each other and have approximately the same length.

The first bottom plate piece 13 is formed in a rectangular shape. The second bottom plate piece 14 includes a trapezoidal bottom plate body 29 in which its width is narrow as it is remote from the second side plate 6. One side of the third bottom plate piece 15 and one side of the fourth bottom plate piece 16, which face the first bottom plate piece 13, are formed as a "L" shaped recess. A distal end 15B of the third bottom plate piece 15 is set to be shorter than the base end 15A. A distal end 16B of the fourth bottom plate piece 16 is set to be shorter than the base end 16A.

As illustrated in FIG. 1, FIG. 2, FIG. 9, and FIG. 10, a first support piece 18 (corresponding to a support piece and see FIG. 1 and FIG. 2), which can assemble a first support body 17 (see FIG. 9 and FIG. 10) that supports one side part in a width direction of a toner container 50, is connected to a distal part of the first bottom plate piece 13. Furthermore, a second support piece 20 (corresponding to a support piece and see FIG. 1 and FIG. 2), which can assemble a second support body 19 (see FIG. 9 and FIG. 10) that supports the other side part in the width direction of the toner container 50, is connected to the bottom plate body 29 of the second bottom plate piece 14. A structure thereof will be described in detail later.

[Structure of Engaging Parts of First to Fourth Bottom Plate Pieces 13 to 16]

Figure 3:
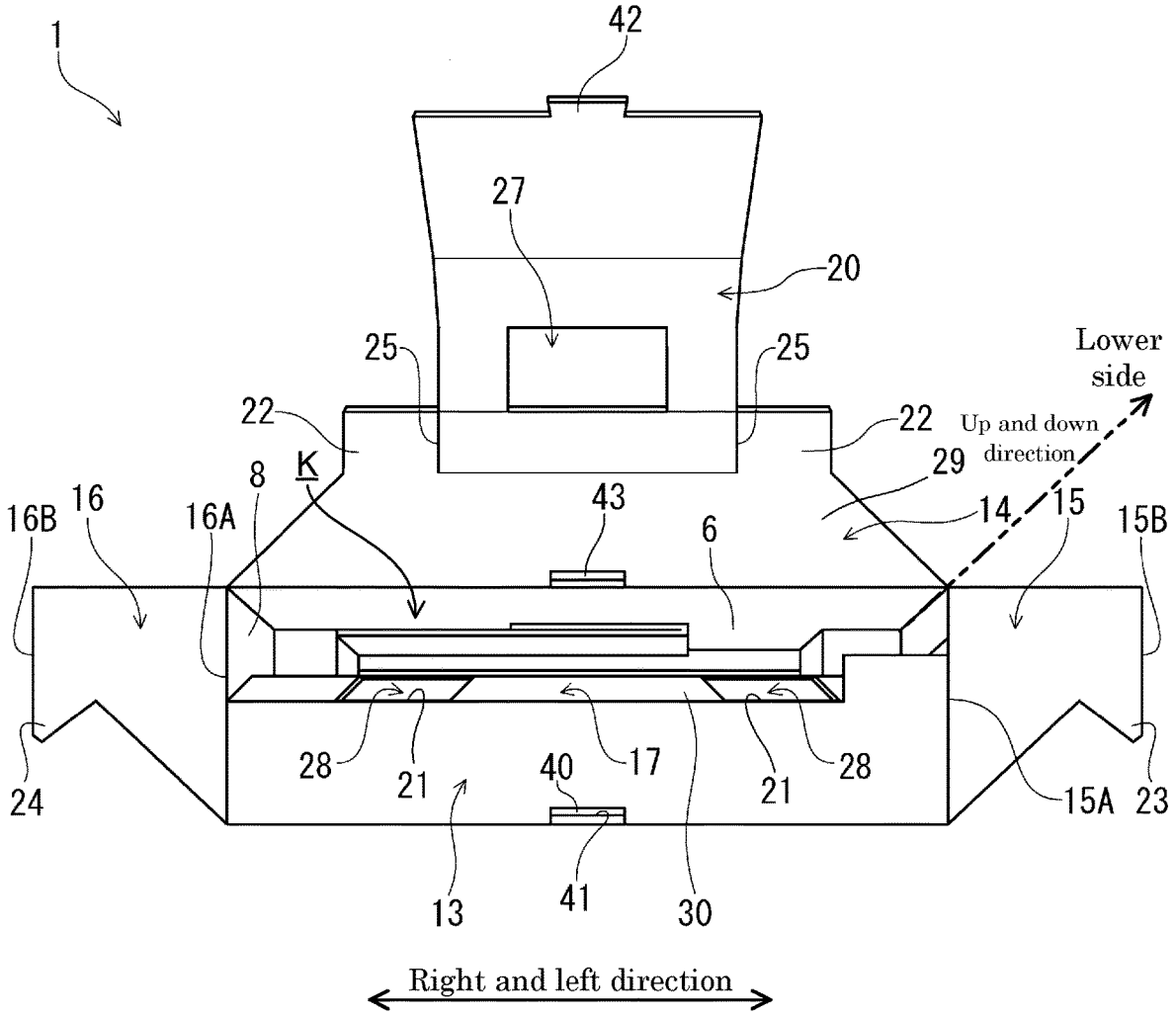
FIG. 3 is a bottom view of a packing case in which a first bottom plate piece is folded to a lower opening side of a body part from a state of FIG. 2.
Figure 6:
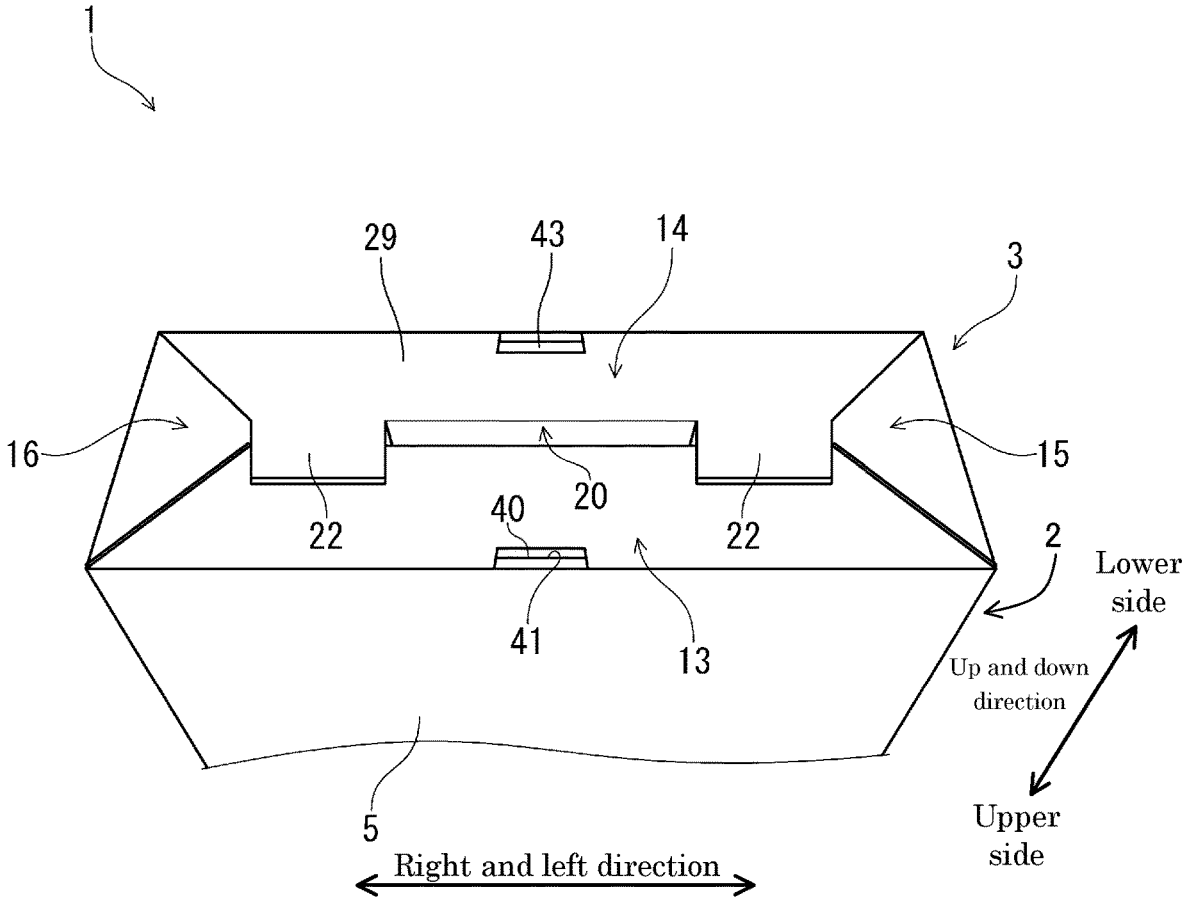
FIG. 6 is a perspective view before a pair of right and left second engaging parts of a second bottom plate piece are respectively inserted and engaged between one of right and left first engaging parts and a third engaging part and the other one of right and left first engaging parts and a fourth engaging part.

As illustrated in FIG. 2 and FIG. 3, the first bottom plate piece 13 is formed at the distal end part thereof with a pair of right and left first engaging parts 21. The first engaging parts 21 are configured as inner peripheral parts of a pair of right and left square holes 28 formed between the first bottom plate piece 13 and the first support piece 18. Furthermore, as illustrated in FIG. 2 and FIG. 6, from the distal end part of the bottom plate body 29 of the second bottom plate piece 14, a pair of right and left second engaging parts 22 protrude. Between the pair of right and left second engaging parts 22, a base end part of the second support piece 20 is positioned, and between the pair of right and left second engaging parts 22 and the base end part of the second support piece 20, notches 25 are respectively formed.

As described above, one side of the third bottom plate piece 15, which faces the first bottom plate piece 13, is formed as the "L" shaped recess, so that a triangular piece-like third engaging part 23 is formed at the distal end part of the third bottom plate piece 15 to protrude toward the first bottom plate piece 13 side. Furthermore, one side of the fourth bottom plate piece 16, which faces the first bottom plate piece 13, is formed as the "L" shaped recess, so that a triangular piece-like fourth engaging part 24 is formed at the distal end part of the fourth bottom plate piece 16 to protrude toward the first bottom plate piece 13 side.

Figure 7:
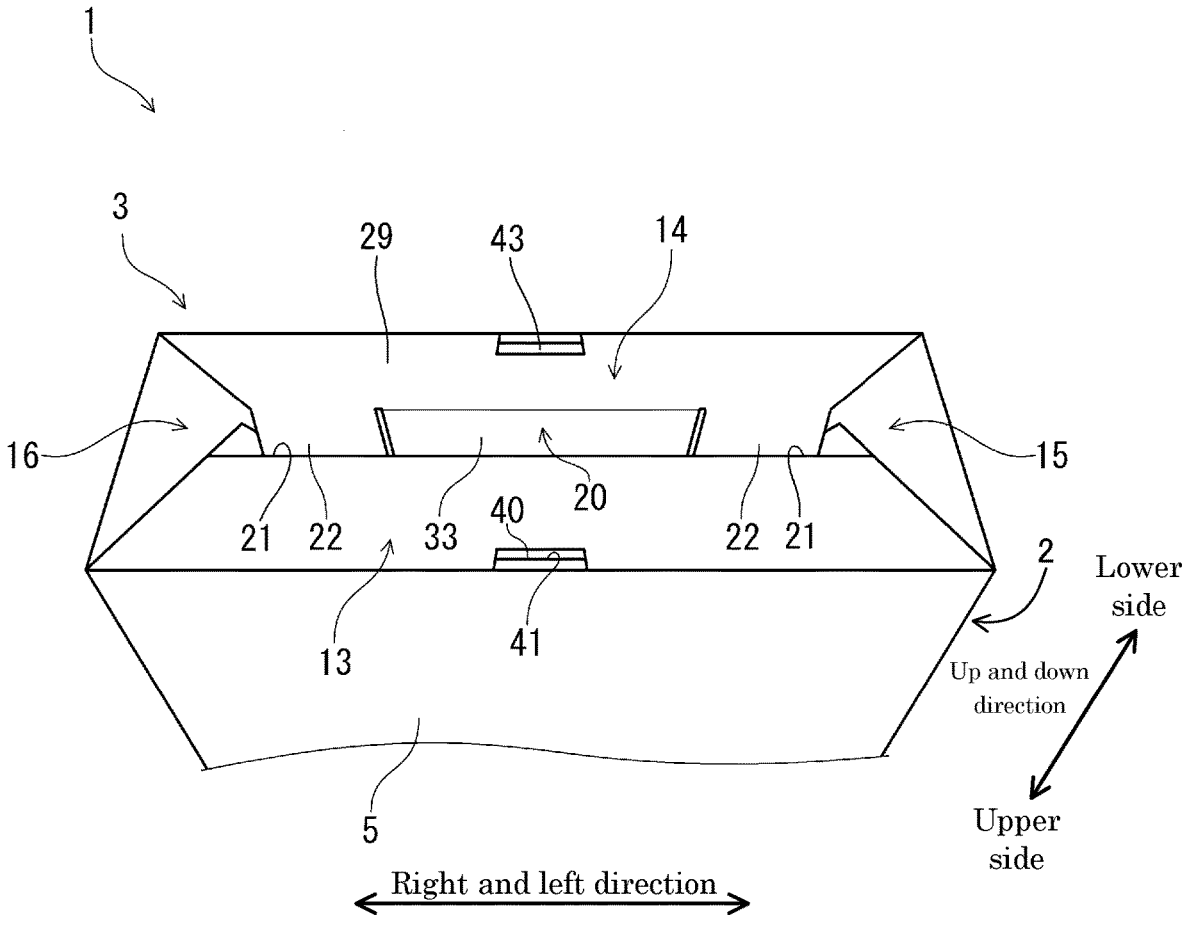
FIG. 7 is a perspective view of a packing case in a state in which a pair of right and left second engaging parts of a second bottom plate piece are respectively inserted and engaged between one of right and left first engaging parts and a third engaging part and the other one of right and left first engaging parts and a fourth engaging part.
Figure 8:
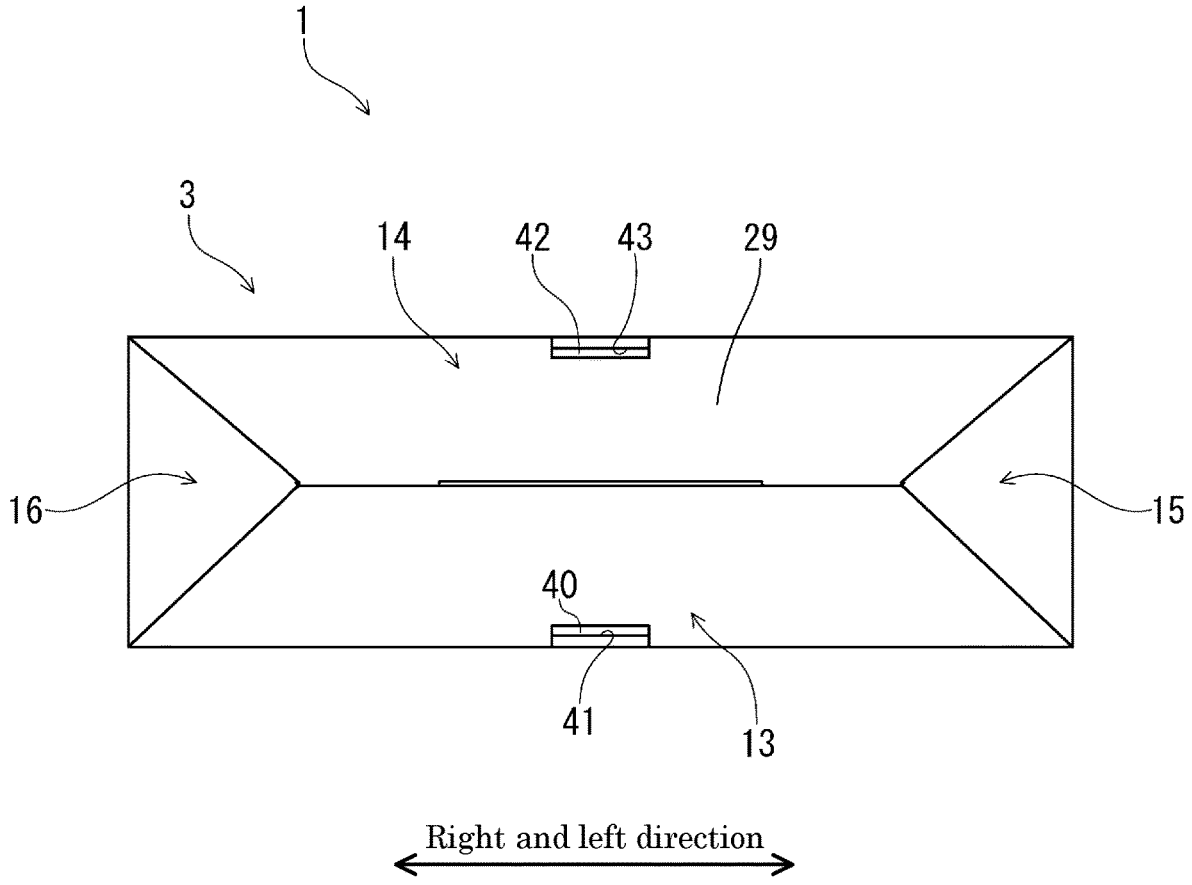
FIG. 8 is a bottom view of a packing case in which the engagement connection of first to fourth bottom plate pieces are completed to form an entangled bottom.

As illustrated in FIG. 3 to FIG. 6, the third engaging part 23 of the third bottom plate piece 15 and the fourth engaging part 24 of the fourth bottom plate piece 16 are respectively engaged with the pair of right and left first engaging parts 21 of the first bottom plate piece 13. Moreover, as illustrated in FIG. 3, FIG. 7, and FIG. 8, one side of the right and left second engaging parts 22 of the second bottom plate piece 14 is inserted and engaged between one side of the right and left first engaging parts 21 and the third engaging part 23, and the other side of the right and left second engaging parts 22 of the second bottom plate piece 14 is inserted and engaged between the other side of the right and left first engaging parts 21 and the fourth engaging part 24. In this way, the bottom part 3 is configured as an entangled bottom.

[Structure of First Support Body 17 and First Support Piece 18]

Figure 9:
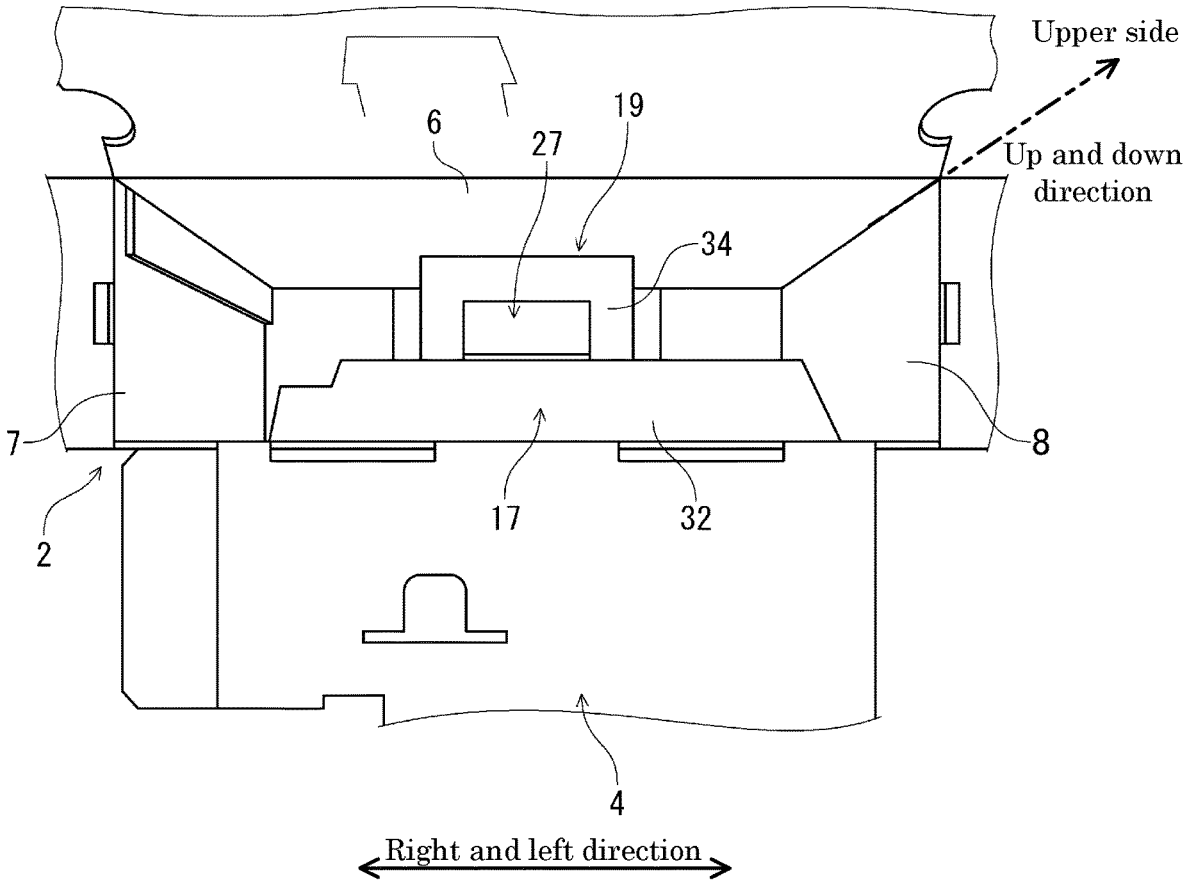
FIG. 9 is a top view of a packing case in which a lid is opened.
Figure 10:
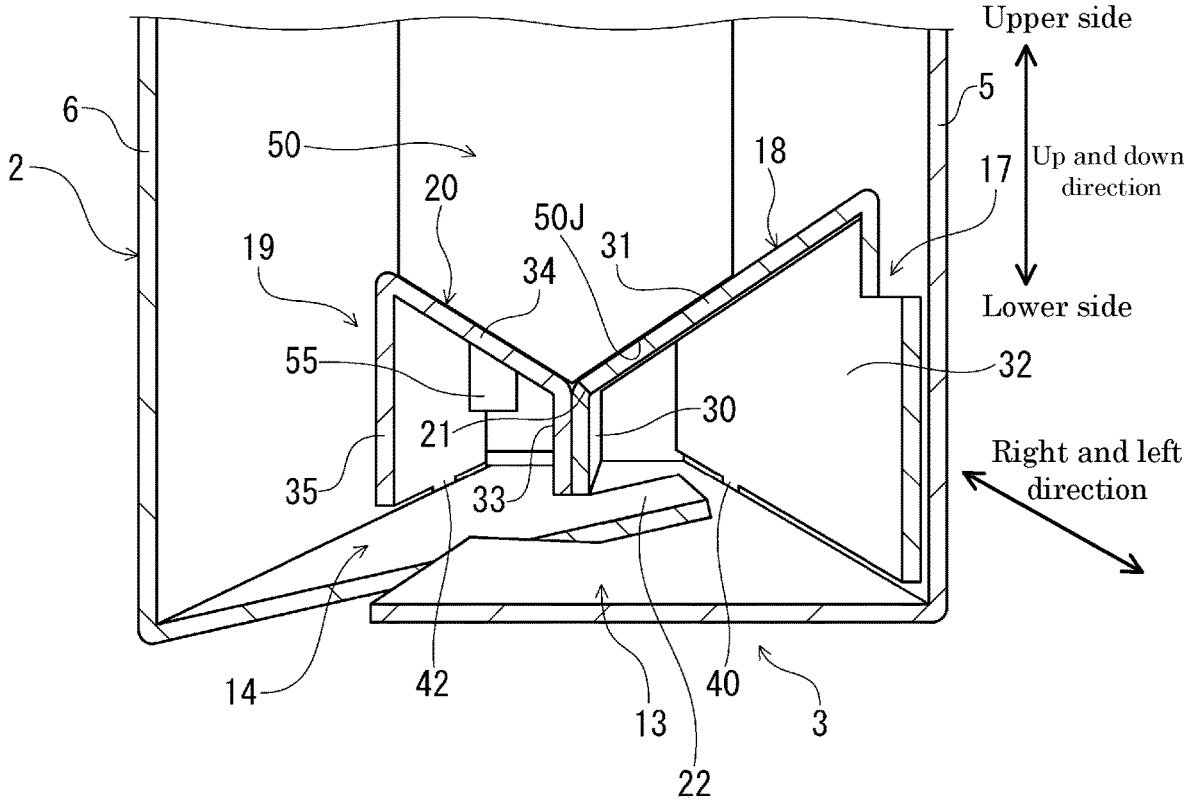
FIG. 10 is a longitudinal sectional view of a bottom part of a packing case.

As illustrated in FIG. 1 and FIG. 2, a plurality of (or one) second fold lines 26 following the base end 13A of the first bottom plate piece 13 are formed in the first support piece 18. As illustrated in FIG. 2, FIG. 9, and FIG. 10, the first support piece 18 is folded along the second fold line 26, so that the first support body 17 is formed in a hollow shape having a semi-trapezoidal section.

As illustrated in FIG. 10, the first support body 17 includes a first rising wall 30, a first inclined wall 31, and a first vertical wall 32. The first rising wall 30 rises from the distal end part of the first bottom plate piece 13. The first inclined wall 31 extends to be positioned at an inner surface side of the first side plate 5 toward an upper side from an apex of the first rising wall 30. The first vertical wall 32 extends downward from an apex of the first inclined wall 31. The first vertical wall 32 overlaps the inner surface of the first side plate 5. Furthermore, a first engaging convex part 40 formed at the center of the distal end part of the first support piece 18 is inserted into and engaged with a first engaging hole 41 (see FIG. 1) formed in the base end part of the first bottom plate piece 13.

[Structure of Second Support Body 19 and Second Support Piece 20]

As illustrated in FIG. 1 and FIG. 2, a plurality of (or one) third fold lines 36 following the base end 14A of the second bottom plate piece 14 are formed in the second support piece 20. As illustrated in FIG. 2 and FIG. 10, the second support piece 20 is folded along the third fold line 36, so that the second support body 19 is formed in a hollow shape having a semi-trapezoidal section.

As illustrated in FIG. 10, the second support body 19 includes a second rising wall 33, a second inclined wall 34, and a second vertical wall 35. The second rising wall 33 rises from the distal end part of the bottom plate body 29 of the second bottom plate piece 14. The second inclined wall 34 extends to be positioned at an inner surface side of the second side plate 6 toward an upper side from an apex of the second rising wall 33. The second vertical wall 35 extends downward from an apex of the second inclined wall 34. The second vertical wall 35 overlaps the inner surface of the second side plate 6. Furthermore, a second engaging convex part 42 formed at the center of the distal end part of the second support piece 20 is inserted into and engaged with a second engaging hole 43 (see FIG. 1) formed in the base end part of the second bottom plate piece 14.

As illustrated in FIG. 10, the first rising wall 30 of the first support body 17 and the second rising wall 33 of the second support body 19 abut each other. In this state, upper surfaces of the first inclined wall 31 of the first support body 17 and the second inclined wall 34 of the second support body 19 form a sectional V shape. On these upper surfaces, a vertically inverted side surface 50J (see FIG. 11) of the toner container 50, which has an approximately triangular chevron shape, is placed and fitted. By the first support body 17 and the second support body 19, it is possible to decide the position of the toner container 50 in the packing case 1 and to absorb the impact on the toner container 50.

As illustrated in FIG. 2 and FIG. 9, the second inclined wall 34 is formed with a rectangular through hole 27 (see FIG. 1), and a knob 55 (see FIG. 11) of the toner container 50 is inserted into the through hole 27 from above.

In this way, it is possible to prevent the knob 55 from interfering with the first support body 17 or the bottom part 3 of the packing case 1, and to prevent damage or whitening of the knob 55. The knob 55 is grasped when the toner container 50 is attached or detached.

[Assembling of Packing Case 1]

(1) As illustrated in FIG. 1, FIG. 2, and FIG. 3, firstly, the first support piece 18 is folded along the plurality of folding lines 26, so that a cylindrical body is formed, and then the first bottom plate piece 13 is folded to the lower opening K side (the back side of the paper surface in FIG. 1) of the body part 2 along the fold line 9, so that the cylindrical body is received in the body part 2 from the lower opening K. Furthermore, the first engaging convex part 40 at the center of the distal end part of the first support piece 18 is inserted into and engaged with the first engaging hole 41 of the base end part of the first bottom plate piece 13.

Figure 4:
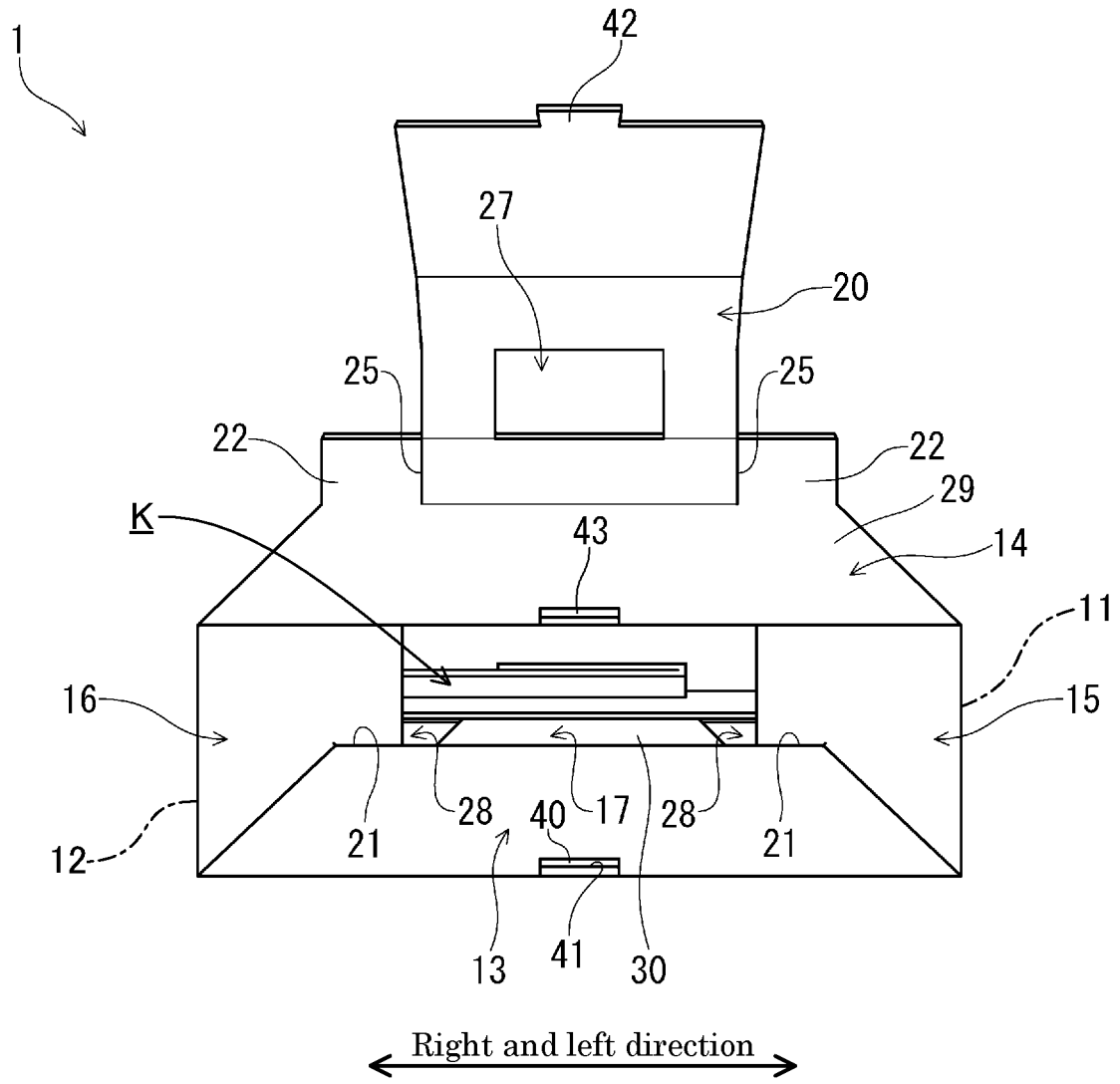
FIG. 4 is a bottom view of a packing case in which a third bottom plate piece and a fourth bottom plate piece are folded to a lower opening side of a body part from a state of FIG. 3.

(2) As illustrated in FIG. 2 and FIG. 4, the third bottom plate piece 15 and the fourth bottom plate piece 16 are respectively folded to the lower opening K side of the body part 2 along the fold lines 11 and 12, and superposed onto both right and left end parts of the first bottom plate piece 13 from an outer side (a lower side) of the packing case 1. Then, the third engaging part 23 of the third bottom plate piece 15 is inserted into one of the right and left square holes 28 of the first bottom plate piece 13 so as to be engaged with the first engaging part 21, and the fourth engaging part 24 of the fourth bottom plate piece 16 is inserted into the other one of the right and left square holes 28 of the first bottom plate piece 13 so as to be engaged with the first engaging part 21 (see FIG. 4).

Figure 5:
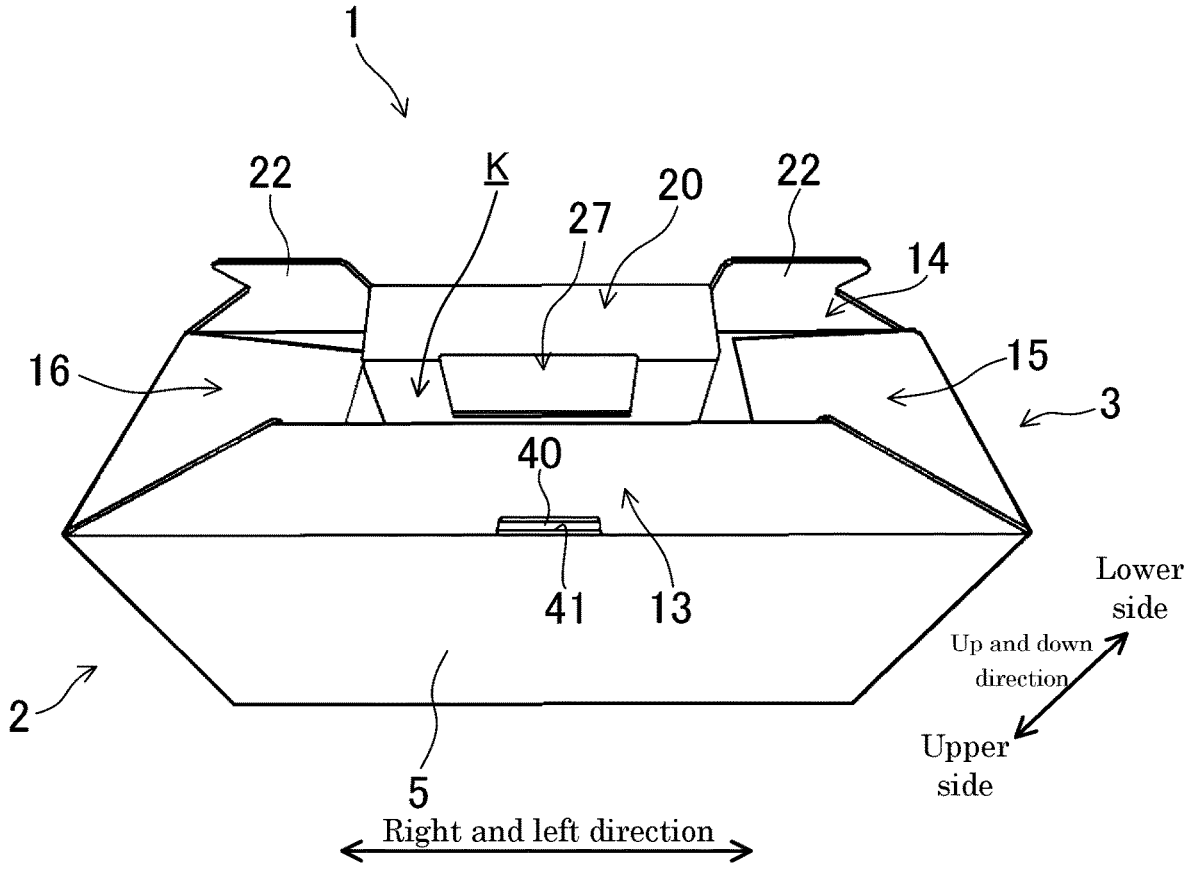
FIG. 5 is a perspective view of a packing case in a state in which a second bottom plate piece and a first bottom plate piece are folded to a lower opening side of a body part from a state of FIG. 4.

(3) As illustrated in FIG. 1 and FIG. 5, the second support piece 20 is folded along the plurality of folding lines 36, so that a cylindrical body is formed, and then the second bottom plate piece 14 is folded to the lower opening K side (the back side of the paper surface in FIG. 1) of the body part 2 along the fold line 10, so that the cylindrical body is received in the body part 2 from the lower opening K.

(4) As illustrated in FIG. 1, FIG. 6, and FIG. 7, one of right and left second engaging parts 22 of the second bottom plate piece 14 is inserted into and engaged with one of the right and left first engaging part 21 and the third engaging part 23, and the other one of right and left second engaging parts 22 of the second bottom plate piece 14 is inserted into and engaged with the other one of the right and left first engaging part 21 and the fourth engaging part 24. Furthermore, the second engaging convex part 42 at the center of the distal end part of the second support piece 20 is inserted into and engaged with the second engaging hole 43 of the base end part of the second bottom plate piece 14.

In the present embodiment, the first support piece 18, which can assemble the first support body 17, is connected to the distal end part of the first bottom plate piece 13 and the second support piece 20, which can assemble the second support body 19, is connected to the distal end part of the second bottom plate piece 14, so that it is possible to reduce the number of parts and man-hours at the time of packing.

Furthermore, the first support piece 18 is merely folded along the folding line 26 and the second support piece 20 is merely folded along the folding line 36, so that it is possible to simply form the first support body 17 and the second support body 19. Moreover, time and effort is not required for the positioning of the first support body 17 and the second support body 19, so that it is possible to improve workability of packing work.

OTHER EMBODIMENTS (1) The support pieces may be configured to be connected via the fold line of only any one of the first to fourth bottom plate pieces 13 to 16. Furthermore, the support pieces may be configured to be connected via the fold lines of three of the first to fourth bottom plate pieces 13 to 16.

(2) The technology of the present disclosure can also be applied to the packing case 1 that receives an object to be packed other than the toner container 50. Furthermore, the object to be packed may be parts of an apparatus other than an image forming apparatus.

(3) The corrugated cardboard may be made of resin.

The aforementioned embodiments are presented as examples and do not intend to limit the technical range of the present disclosure.

What is claimed is:

1. A packing case comprising:

a body part having a quadrangular section and a bottom part for closing a lower opening of the body part, wherein the body part includes a first side plate, a second side plate, a third side plate, and a fourth side plate, which form sides of the quadrangle, a first bottom plate piece, a second bottom plate piece, a third bottom plate piece, and a fourth bottom plate piece are respectively connected to lower end parts of the first side plate, the second side plate, the third side plate, and the fourth side plate via fold lines, the bottom part is configured by allowing the first bottom plate piece, the second bottom plate piece, the third bottom plate piece, and the fourth bottom plate piece folded to a side of the lower opening along the fold lines to be engaged with one another and to be integrally connected with one another, a support piece, which is able to assemble a support body that supports an object to be packed, is connected to at least one of the first bottom plate piece, the second bottom plate piece, the third bottom plate piece, and the fourth bottom plate piece, the first side plate and the second side plate are disposed facing each other and the third side plate and the fourth side plate are disposed facing each other, a pair of first engaging parts are formed in the first bottom plate piece connected to the first side plate, a pair of second engaging parts are formed in the second bottom plate piece connected to the second side plate, a third engaging part is formed in the third bottom plate piece connected to the third side plate, a fourth engaging part is formed in the fourth bottom plate piece connected to the fourth side plate, the third engaging part and the fourth engaging part are respectively engaged with the pair of first engaging parts, one of the pair of second engaging parts is inserted and engaged between one of the pair of first engaging parts and the third engaging part, the other one of the pair of second engaging parts is inserted and engaged between the other one of the pair of first engaging parts and the fourth engaging part, the support piece includes a first support piece connected to a distal end part of the first bottom plate piece and a second support piece connected to a distal end part of the second bottom plate piece, at least one second fold line following a base end of the first bottom plate piece is formed in the first support piece, at least one third fold line following a base end of the second bottom plate piece is formed in the second support piece, and the support body includes a first support body assembled by folding the first support piece along the second fold line, and a second support body assembled by folding the second support piece along the third fold line.

* * * * *